US005236040A

United States Patent [19]

Venditto et al.

[11] Patent Number: 5,236,040

[45] Date of Patent: Aug. 17, 1993

[54] METHOD FOR DETERMINING THE MINIMUM PRINCIPLE HORIZONTAL STRESS WITHIN A FORMATION THROUGH USE OF A WIRELINE RETRIEVABLE CIRCUMFERENTIAL ACOUSTIC SCANNING TOOL DURING AN OPEN HOLE MICROFRAC TEST

[75] Inventors: James J. Venditto, Duncan; David E. McMechan, Marlow; Milton B. Enderlin, Bartlesville, all of Okla.

[73] Assignees: Halliburton Logging Services, Inc., Houston, Tex.; Halliburton Company, Duncan, Okla.

[21] Appl. No.: 897,325

[22] Filed: Jun. 11, 1992

[51] Int. Cl.[5] ..... E21B 47/06; E21B 49/00; E21B 43/26

[52] U.S. Cl. ..... 166/250; 166/308; 73/151

[58] Field of Search ..... 166/250, 308; 73/151, 73/155; 181/103, 105, 106; 367/86

[56] References Cited

U.S. PATENT DOCUMENTS

| | | | |
|---|---|---|---|
| 3,739,871 | 6/1973 | Bailey | 166/250 X |
| 4,044,828 | 8/1977 | Jones et al. | 166/250 X |
| 4,415,035 | 11/1983 | Medlin et al. | 166/250 X |
| 4,432,078 | 2/1984 | Silverman | 166/308 X |
| 4,442,895 | 4/1984 | Lagus et al. | 166/250 |
| 4,529,036 | 7/1985 | Daneshy et al. | 166/254 |
| 5,044,462 | 9/1991 | Maki, Jr. | 181/103 |
| 5,050,674 | 9/1991 | Soliman et al. | 166/308 X |

OTHER PUBLICATIONS

Halliburton Logging Services, Inc. Publication No. EL-1055, Aug. 1989 (3 pages).

Seiler, Edmiston, Torres and Goetz, "Field Performance of a New Borehole Televiewer Tool and Associated Image Processing Techniques", Jun. 1990 (19 pages).

Goetz, Seiler and Edmiston, "Geological and Borehole Features Described by the Circumferential Acoustic Scanning Tool"; SPWLA 31st Annual Logging Symposium, Jun. 1990 (21 pages).

Torres, Strickland and Gianzero, "A New Approach to Determining Dip and Strike Using Borehole Images"; SPWLA 31st Annual Logging Symposium, Jun. 1990 (16 pages).

Halliburton Logging Services, Inc. "TELECAST" flier; Jan. 1990 (1 page).

Halliburton Logging Services, Inc., publication, "An Introduction to the HLS Borehole Televiewer"; 1990 (15 pages).

Halliburton Logging Services, Inc. publication, "CAST—the Circumferential Acoustic Scanning Tool"; 1990 (3 pages).

Halliburton Logging Services, Inc. publication, "Full Wave Sonic Log", Mar. 1986 (11 pages).

*Primary Examiner*—Stephen J. Novosad

*Attorney, Agent, or Firm*—Arnold, White & Durkee

[57] ABSTRACT

An improved method for determining the magnitude of the minimum principle horizontal stress within a formation is disclosed and claimed herein. In particular, the inventive method involves the use of a wireline retrievable circumferential acoustic scanning tool during an open hole microfracture test to determine the magnitude of the minimum principle horizontal stress in the formation.

2 Claims, 1 Drawing Sheet

METHOD FOR DETERMINING THE MINIMUM PRINCIPLE HORIZONTAL STRESS WITHIN A FORMATION THROUGH USE OF A WIRELINE RETRIEVABLE CIRCUMFERENTIAL ACOUSTIC SCANNING TOOL DURING AN OPEN HOLE MICROFRAC TEST

BACKGROUND OF THE INVENTION

1. Field of the Invention

The present invention relates generally to hydraulic fracturing of oil wells, and particularly to a method for determining the magnitude of the least principle horizontal stress existing within a given formation.

2. Prior Art

After a well has been drilled to the desired depth of production, it is necessary to fracture the formation if production of commercially significant quantities of hydrocarbons are to be produced from the well. Fracturing procedures generally involve pumping a fracturing fluid to a given area of the formation under sufficiently high pressure so as to cause fractures to initiate in the formation. When fracturing operations are completed, these fractures extend radially away from the well bore and run in a direction perpendicular to the least principle horizontal stress existing within the field.

Many different techniques have been employed to determine the magnitude of the minimum principle stress within a formation. One of the techniques employed is known as an open hole microfrac test. The open hole microfrac test procedure is the subject of U.S. Pat. No. 4,529,036, which is hereby incorporated by reference. In that procedure, the magnitude of the least principle horizontal stress in the formation is determined by recording and interpreting pressure responses occurring during a series of pump shut in and flow back tests after fractures have been initiated in the formation. In particular, the magnitude of the minimum principle stress may be estimated by interpreting changes in the slope of a graph of the downhole pressure readings made during the microfrac procedure.

However, the information obtained during an open hole microfrac test was sometimes inaccurate due to the difficulty in recording and interpreting pressure responses during the fracturing procedure. Therefore, a need exists within the industry for a method that will allow accurate and reliable determination of the magnitude of the minimum principle horizontal stress existing within a formation. The invention disclosed and claimed herein satisfies this requirement.

SUMMARY OF THE INVENTION

The present invention provides a method to reliably and accurately determine the magnitude of the least principle horizontal stress existing within a formation.

The present invention also makes efficient fracturing of wells possible by providing accurate information as to the magnitude of the minimum principle horizontal stress within the formation.

These and other uses of the present invention will be readily apparent to those of ordinary skill in the art.

DETAILED DESCRIPTION

Figure 1:
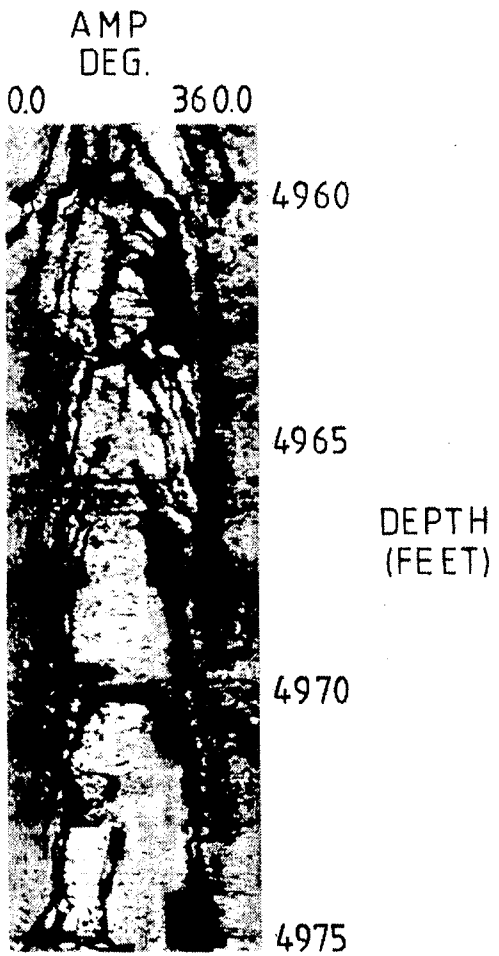
FIG. 1 is a photograph of a representation of an open fracture in a well bore as shown on the amplitude raster scan image produced by use of a circumferential acoustic scanning tool.

It is well known that after initiation of fractures within a formation, the fractures may be forced open and caused to propagate radially away from the well bore in a direction that is perpendicular to the minimum principle horizontal stress existing in the surrounding formation, i.e., the direction of propagation of the fractures is controlled by the state of stress existing in the surrounding formation. After initial fracturing, the fractures are typically propagated into the formation by pumping a fracturing fluid, under high pressure, into the previously initiated fractures until the pressure is sufficient to force open the fractures, i.e., until the pressure exceeds the minimum principle horizontal stress within the formation. By continuously pumping the fracturing fluid into the fractures, the fractures may be forced open and propagated further into the formation. Additionally, the fractures become wider at the well bore the further the fractures are propagated into the formation.

Proppants are also typically added to the fracturing fluid to ensure that the fractures do not fully close whenever the pressure on the fracturing fluid is reduced. In all cases, the fracturing fluid must supply sufficient energy to force the fractures to open, i.e., energy must be supplied to overcome the minimum principle horizontal stress within the formation. Therefore, it would be advantageous to know the magnitude of the minimum stress within a given formation prior to designing a fracture treatment for a well and fracturing the formation.

In one method of initiating fractures, referred to as the open hole microfrac test, a fracturing fluid is pumped down the well bore to the area of interest within the formation. The pressure on the fracturing fluid is then gradually increased until it is sufficiently high to initiate minor fractures on the inner surface of the well bore and propagate them a short distance into the formation. Since this fracturing technique is employed in an open hole situation, the fractures will usually align in a direction that is perpendicular to the least principle horizontal stress within the formation.

For a variety of reasons, there has always been a desire to determine the magnitude of the least principle horizontal stress in a formation, e.g., to properly design a fracturing treatment for a given well, and to insure that the equipment present during fracturing operations is sufficient to produce enough pressure to overcome the minimum principle stress within the field. However, the use of the open hole microfrac test, or any other technique, to determine the magnitude of the minimum principle stress, did not produce completely satisfactory results. This resulted primarily because the magnitude or the minimum principle stress was typically determined solely from interpretations of pressure recordings made during the microfrac test.

Typically, during the microfrac test, the highest pressure on the fracturing fluid existed just prior to initiation of the fractures. Thereafter, just after the initiation of the fractures, the pressure on the fracturing fluid naturally decreased as the fracturing fluid extended the initial fractures a short distance into the formation. Despite efforts within the industry to use very sensitive pressure transducers, interpretation of the pressure decline curve has been limited because of the ability to interpret the data when compared to an ideal situation.

Through the use of a Circumferential Acoustical Scanning Tool (CAST) during the open hole microfrac test, the aforementioned problems in determining the magnitude of the minimum principle horizontal stress may be overcome.

The CAST is the subject of U.S. Pat. No. 5,044,462, which is hereby incorporated by reference. By way of background, the CAST provides full borehole imaging through use of a rotating ultrasonic transducer. The transducer, which is in full contact with the borehole fluid, emits high-frequency pulses which are reflected from the borehole wall. The projected pulses are sensed by the transducer, and a logging system measures and records reflected pulse amplitude and two-way travel time. The CAST provides a very thorough acoustic analysis of the well bore as typically some 200 shots are recorded in each 360° of rotational sweep, and each rotational sweep images about 0.3" in the vertical direction; however, these parameters may be varied as the CAST has variable rotational speed and a selectable circumferential sampling rate, as well as variable vertical logging speeds.

The images produced by the CAST yield very useful information, not only about stress magnitude, but also about fracture direction, formation homogeneity, bedding planes, as well as other geological features. The amplitude and travel time logs are typically presented as raster scan images. The raster scan televiewer images produce grey level images which can be processed to produce a variety of linear color scales to reflect amplitude and/or travel time variations.

However, it must be remembered that sonic energy, not light, is responsible for the illumination of the details of the interior of the borehole. The amount of illumination, otherwise known as gray shading, of a particular point of the amplitude image is determined by the amount of returning sonic energy; white indicates the highest amount of returned energy while black represents that very little, or essentially no sonic energy has returned from a particular shot.

Likewise, in the case of travel time, white shading represents a fast travel time, while black represents a very long travel time, or no return. Since travel time is normally dependent on the distance of the two-way traverse, it can be surmised that the objects which are light gray or white are relatively close to the transducer, and objects which are dark gray or black are relatively far away.

In general, fine grain, competent rocks, such as massive carbonates and tight sandstones, make good sonic reflectors. This means that televiewer images of these types of rocks would be white or light gray in amplitude, and probably travel time as well. On the other hand, shales and friable sandstones usually exhibit a rough, irregular reflective surface. Therefore, the images of such rocks are most likely to black or dark gray.

The CAST is very useful in fracture reconnaissance. Because the CAST is recording a 360° gap-free image, as opposed to simple log curves, spatial consideration such as fracture width, density, and orientation may be recognized and mapped. In particular, use of the CAST during an open hole microfrac test allows determination of the magnitude of the minimum principle horizontal stress.

Figure 2:
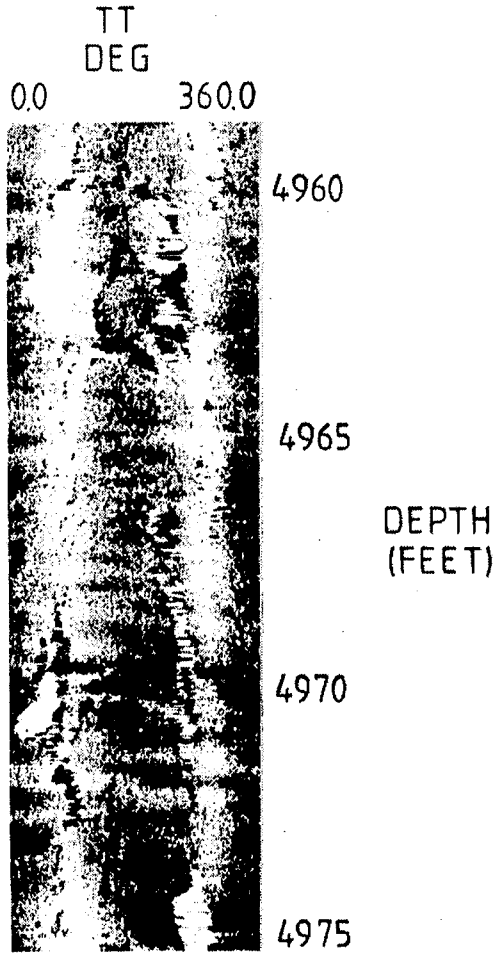
FIG. 2 is another photograph of a representation of an open fracture in a well bore as shown on the travel time raster scan image produced by use of a circumferential acoustic scanning tool.

In order to determine the magnitude of the minimum principle stress with use of the CAST, it is necessary to distinguish open fractures from closed fractures. In order to distinguish open from closed fractures, a fracture pattern must first be recognized in the amplitude image as shown in FIG. 1. Next, the analyst must look for the corresponding pattern expression in the travel time track. If no corresponding pattern exists, it can be assumed that no cavity exists where the fracture intersects the borehole; therefore, the fracture is closed. If a black shading does exist in the corresponding pattern of the travel time track as shown in FIG. 2, then the CAST has detected a cavity at the intersection of the fracture and the borehole; therefore, the fracture is assumed to be open.

Use of the CAST in conjunction with the open hole microfrac test will solve many of the aforementioned problems in determining the magnitude of the minimum principle horizontal stress. The wireline retrievable CAST may be lowered into the well bore during the microfrac test. Thereafter, the pressure of the fracturing fluid is gradually increased until microfractures are induced in the formation. As always, pressure changes and magnitudes may be recorded throughout the microfrac test.

However, through use of the CAST during the microfrac test, the magnitude of the minimum principle stress within the formation may be accurately determined and confirmed. In particular, with the CAST downhole, the pressure on the fracturing fluid may be reduced such that the fractures induced during the open hole microfrac test close, i.e., the pressure on the fracturing fluid is reduced such that it is less than the magnitude of the minimum principle horizontal stress. The closing of the induced fractures may be directly observed from the images produced by the CAST. The CAST image of a fracture upon closure may vary, e.g., after some initial closure it may stabilize and appear as a constant width, or, if the fractures close very tightly, it may appear as a very fine line, or in certain instances, it may even appear to disappear on the CAST image.

Thereafter, the pressure or the fracturing fluid may be gradually increased until the fractures are opened, i.e., until the pressure exerted on the fracturing fluid is sufficient to overcome the minimum principle horizontal stress in the formation. The opening of the fractures may also be directly observed from the images produced by the CAST. In particular, as set forth above, the opening of the fractures is first observed in the amplitude image, and then confirmed in the travel time track.

Thus, by noting the magnitude of the pressure exerted on the fracturing fluid as the previously initiated fractures open or close, the magnitude of the minimum principle stress may be determined. Additionally, this value may be confirmed by repeating the above process.

Through use of the CAST during the open hole microfrac test, the magnitude of the minimum principle stress within a formation may be accurately and quickly determined. This new method will increase the efficiency of fracturing operations, as accurate information as to magnitude of the minimum principle stress will, inter alia, allow for efficient design of fracturing treatments and insure the presence of sufficient equipment to properly fracture the well.

Although a specific embodiment of the present invention has been disclosed herein, the invention should not be construed as to be so limited. Rather, the invention should be construed so as to cover all equivalents of inventive methods disclosed and claimed herein.

What is claimed:

1. A method for determining the magnitude of the minimum principle horizontal stress within a formation having an open hole well bore formed therein, comprising the steps of:

supplying pressurized fracturing fluid to said well bore in a desired area of observation, said well bore exposing an interior surface of said formation;

inserting a circumferential acoustic scanning tool into said well bore and positioning said tool in said area of observation, said acoustic scanning tool providing a viewable image of said interior surface of said formation;

increasing the pressure on said fracturing fluid until fractures are initiated in said formation proximate the well bore;

increasing the pressure acting on said fracturing fluid so as to cause said initiated fractures to further open;

observing the interior surface of said formation during said opening of said previously initiated fractures; and noting the magnitude of the pressure acting on said fracturing fluid as said previously initiated fractures are opened.

2. A method for determining the magnitude of the minimum principle horizontal stress within a formation having an open hole well bore formed therein, comprising the steps of:

supplying pressurized fracturing fluid to said well bore in a desired area of observation, said well bore exposing an interior surface of said formation;

inserting a circumferential acoustic scanning tool into said well bore and positioning said tool in said area of observation, said acoustic scanning tool providing a viewable image of said interior surface of said formation;

increasing the pressure on said fracturing fluid until fractures are initiated in said formation proximate the well bore;

decreasing the pressure acting on said fracturing fluid so as to cause said initiated fractures to close;

observing the interior surface of said formation during said closing of said previously initiated fractures; and noting the magnitude of the pressure acting on said fracturing fluid as said previously initiated fractures are closed.

* * * * *